US010240611B2

(12) United States Patent
Evans, Jr. et al.

(10) Patent No.: US 10,240,611 B2
(45) Date of Patent: Mar. 26, 2019

(54) FLOW CONDITIONING FEATURE FOR SUCTION DIFFUSER

(71) Applicant: Fluid Handling LLC, Morton Grove, IL (US)

(72) Inventors: Stanley P. Evans, Jr., Tinley Park, IL (US); Mikhail P. Strongin, Northbrook, IL (US); Florin Rosca, Niles, IL (US); Manish Sharma, Haryana (IN); Ravi K. Laveti, Hyderabad (IN); Sameer K. Ande, Hyderabad (IN)

(73) Assignee: Fluid Handling LLC, Morton Grove, IL (US)

( * ) Notice: Subject to any disclaimer, the term of this patent is extended or adjusted under 35 U.S.C. 154(b) by 515 days.

(21) Appl. No.: 14/070,771

(22) Filed: Nov. 4, 2013

(65) Prior Publication Data

US 2014/0140837 A1 May 22, 2014

Related U.S. Application Data

(60) Provisional application No. 61/722,411, filed on Nov. 5, 2012.

(51) Int. Cl.
*F04D 29/42* (2006.01)
*F04D 29/44* (2006.01)

(52) U.S. Cl.
CPC ..... *F04D 29/4273* (2013.01); *F04D 29/448* (2013.01)

(58) Field of Classification Search
CPC ..... F04D 29/4213; F04D 29/4273; F04D 29/4293; F04D 29/44; F04D 29/444; F04D 29/448; F04D 29/70; F04D 29/708
See application file for complete search history.

(56) References Cited

U.S. PATENT DOCUMENTS 2,941,474 A 6/1960 Hall
3,438,329 A * 4/1969 Fuller ..... F04D 29/448 415/199.3

(Continued)

FOREIGN PATENT DOCUMENTS

CA 2324121 5/2001
GB 1317757 A 5/1973

(Continued)

OTHER PUBLICATIONS

JP6123297—English Language Machine Translation from Google Translate (7 pages), May 6, 1994.

(Continued)

*Primary Examiner* — Justin Seabe
*Assistant Examiner* — Juan G Flores
(74) *Attorney, Agent, or Firm* — Ware, Fressola, Maguire & Barber LLP

(57) ABSTRACT

A suction diffuser or arrangement is provided featuring a main suction diffuser body and a flow conditioning arrangement. The main suction diffuser body is configured with an inlet to receive an incoming fluid flow, an interior cavity to receive the incoming fluid from the inlet, and an outlet to receive the incoming fluid from the interior cavity and provide an outgoing fluid. The flow conditioning arrangement is configured in relation to the inlet and also comprises a flow conditioning portion having at least one inwardly contoured surface, configured to extend into the interior cavity, diffuse the incoming fluid passing from the inlet into the interior cavity, and provide a flow conditioning that produces a uniform flow of the outgoing fluid by directing the incoming fluid towards the outlet, based at least partly on a contoured design corresponding to the at least one inwardly contoured surface.

18 Claims, 6 Drawing Sheets

(56) References Cited

U.S. PATENT DOCUMENTS

| | | | | |
|---|---|---|---|---|
| 3,670,382 | A | 6/1972 | Keehan | |
| 4,571,948 | A | 2/1986 | Orenstein | |
| 4,865,519 | A | 9/1989 | Diankui et al. | |
| 6,296,454 | B1 | 10/2001 | Schmid et al. | |
| 6,439,853 | B2 | 8/2002 | Tormaschy et al. | |
| 6,595,746 | B1 | 7/2003 | Goto et al. | |
| 6,695,580 | B2 | 2/2004 | Finkenbinder | |
| 6,699,008 | B2 | 3/2004 | Japikse | |
| 7,025,557 | B2 | 4/2006 | Japikse et al. | |
| 7,279,095 | B2 | 10/2007 | Usui et al. | |
| 7,281,904 | B2 | 10/2007 | Schultz et al. | |
| 7,377,313 | B2 | 5/2008 | Brown et al. | |
| 7,442,006 | B2 * | 10/2008 | Nguyen | F04D 29/4206 29/889.22 |
| 7,445,429 | B2 | 11/2008 | Wilson et al. | |
| 7,789,617 | B2 | 9/2010 | Wahl et al. | |
| 7,841,826 | B1 | 11/2010 | Phillips | |
| 8,052,384 | B2 | 11/2011 | Blewett et al. | |
| 8,057,091 | B2 | 11/2011 | Tormaschy et al. | |
| 8,061,983 | B1 | 11/2011 | Bowers et al. | |
| 8,105,049 | B2 | 1/2012 | Schultz | |
| 8,162,600 | B2 | 4/2012 | Brown et al. | |
| 8,245,890 | B2 | 8/2012 | Koch | |
| 2002/0081211 | A1 | 6/2002 | Benghezal et al. | |
| 2004/0057852 | A1 * | 3/2004 | Evans | F04D 29/708 417/423.9 |
| 2005/0042105 | A1 | 2/2005 | Nishiyama et al. | |
| 2007/0036646 | A1 | 2/2007 | Nguyen et al. | |

FOREIGN PATENT DOCUMENTS

| | | | |
|---|---|---|---|
| JP | S-56109697 | U * | 1/1980 |
| JP | 55032974 | | 3/1980 |
| JP | 19946123297 | | 5/1994 |
| JP | 2013104308 | A | 5/2013 |
| KR | 20100040494 | A | 4/2010 |
| RU | 117531 | | 6/2012 |
| SU | 920264 | | 1/1978 |
| SU | 1483095 | A1 | 5/1989 |
| SU | 1760170 | A1 | 9/1992 |

OTHER PUBLICATIONS

JP55032974—English Language Abstract (1 page), Mar. 7, 1980.
English language abstract of SU1760170 not available.
English language abstract of SU1483095 not available.
English language abstract and translation of RU117531.
English language abstract of JP2013104308.
English language abstract of KR20100040494.

* cited by examiner

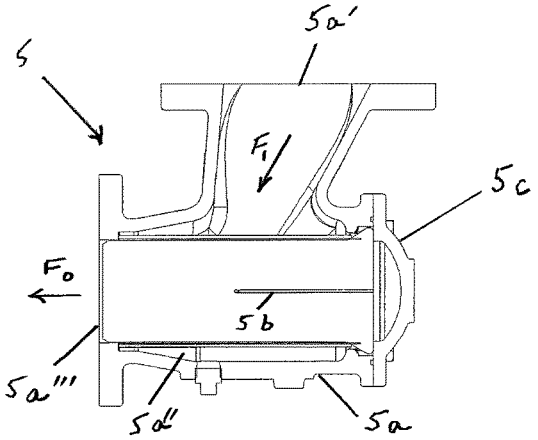
Figure 1: Known suction diffuser (Prior art)
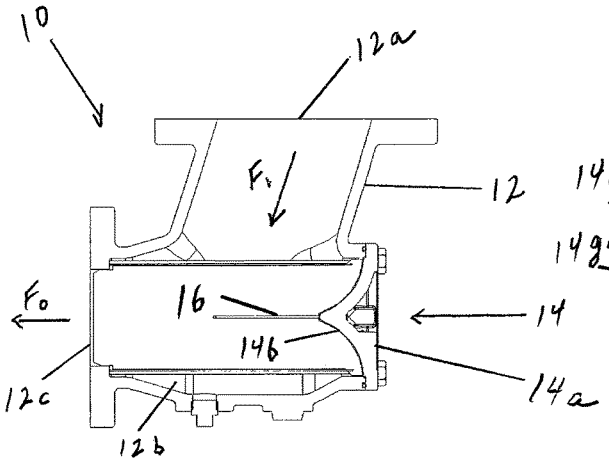
Figure 2a: Suction diffuser
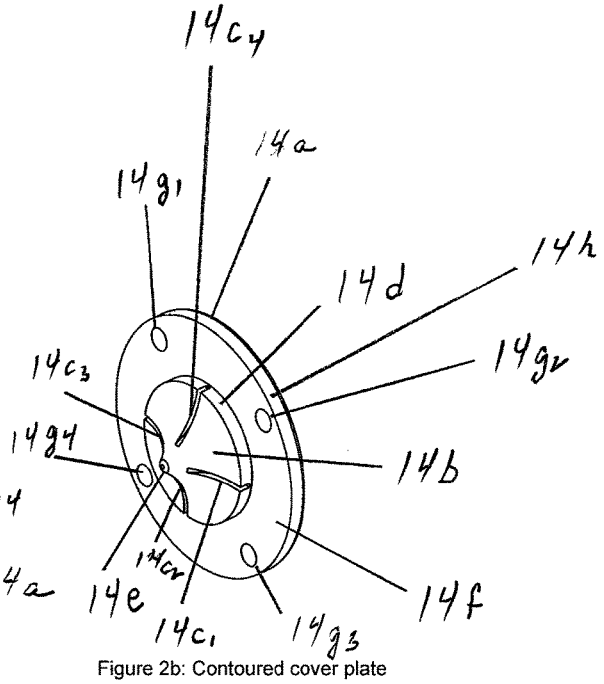
Figure 2b: Contoured cover plate

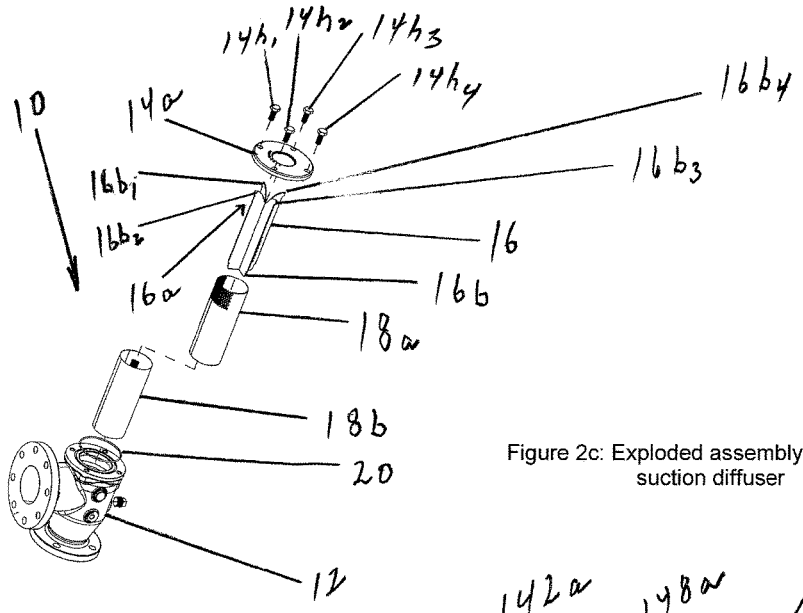
Figure 2c: Exploded assembly view of the suction diffuser
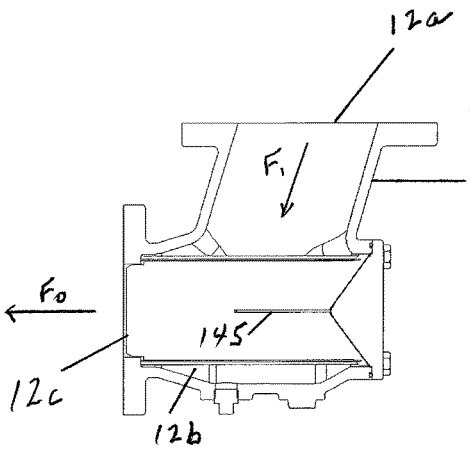
Figure 3a: Suction diffuser
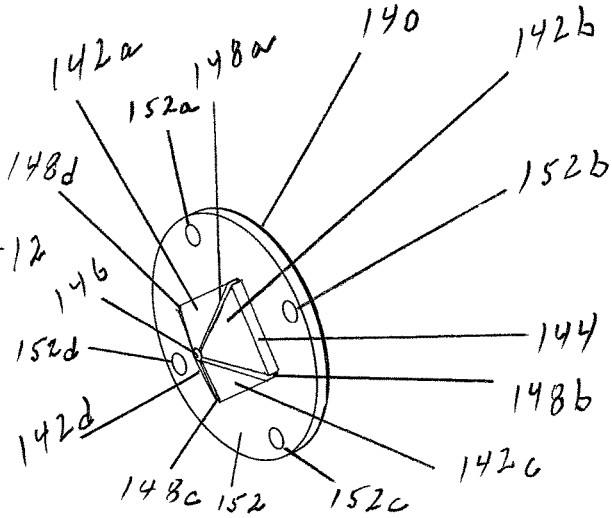
Figure 3b (Cover plate with pyramidal or geometric contour)

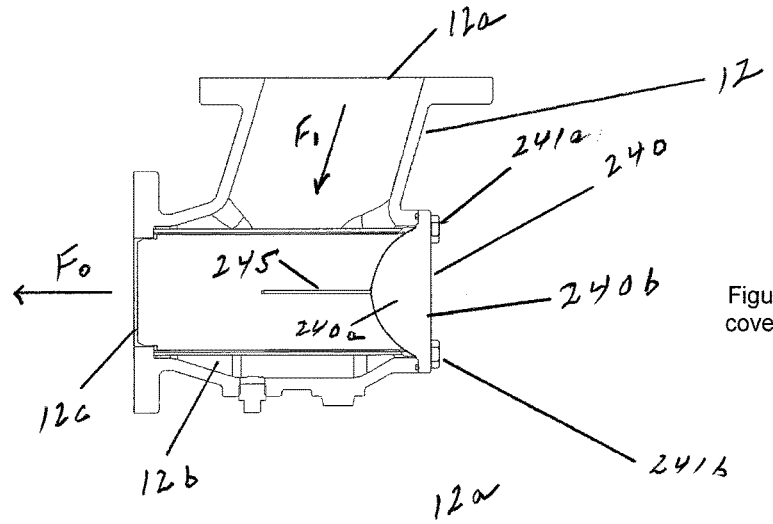
Figure 4: Suction diffuser having cover plate with concave contour
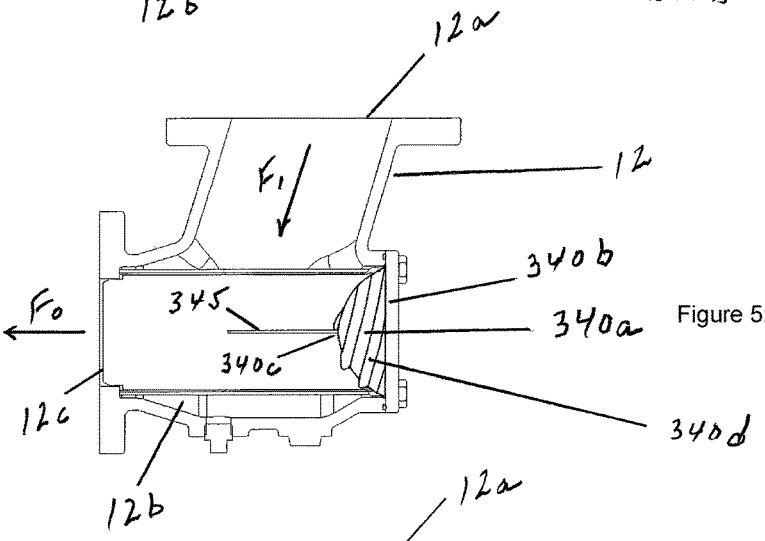
Figure 5: Suction diffuser having cover plate with helical contour
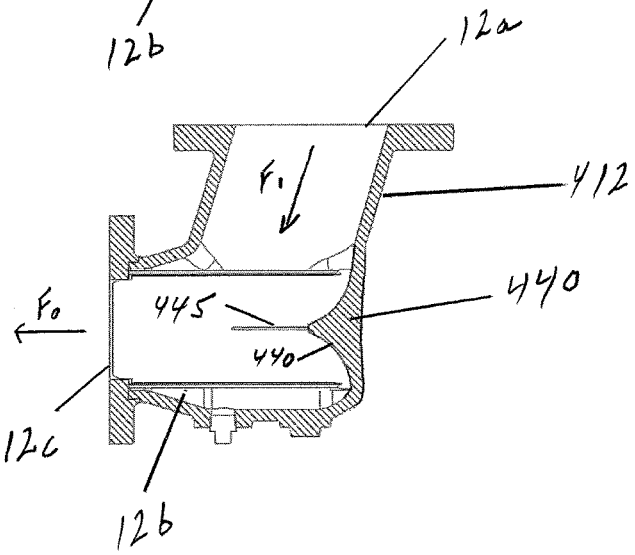
Figure 6: Suction diffuser having cover plate Integral to main suction diffuser body

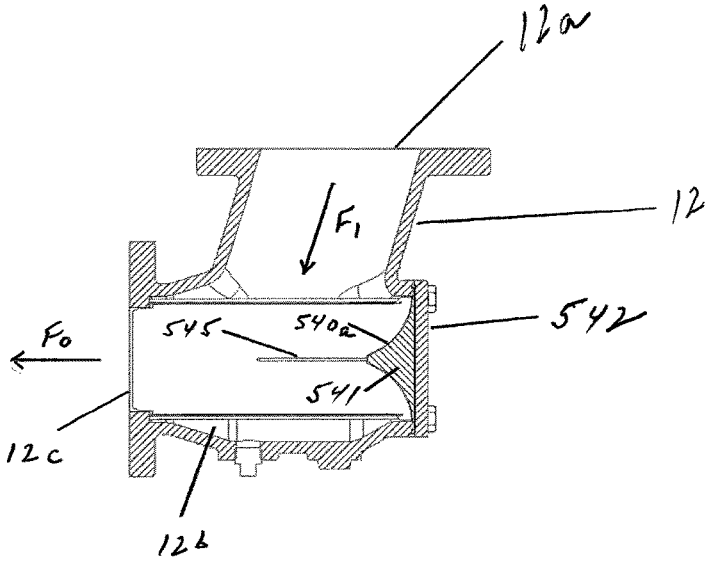
Figure 7: Suction diffuser having inserted contour plate
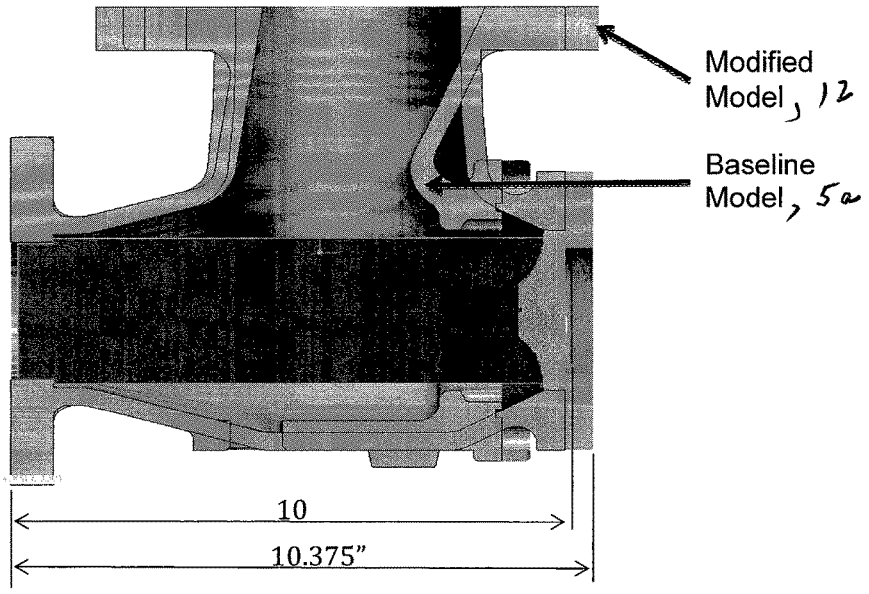
Figure 8: Overlay view of present invention (Figures 2a-2c) and known assembly (Figure 1)

Figure 9a (Prior art)
Fluid Velocity Vectors
Showing Recirculation & Stagnation Zones
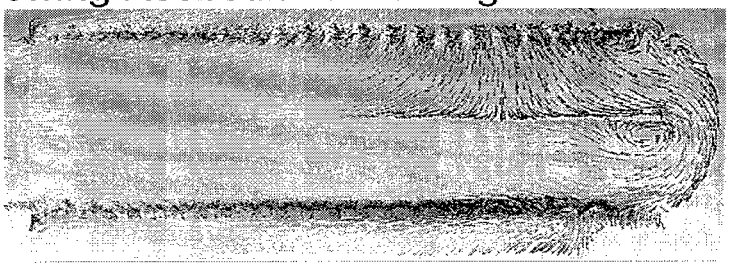
Old Design
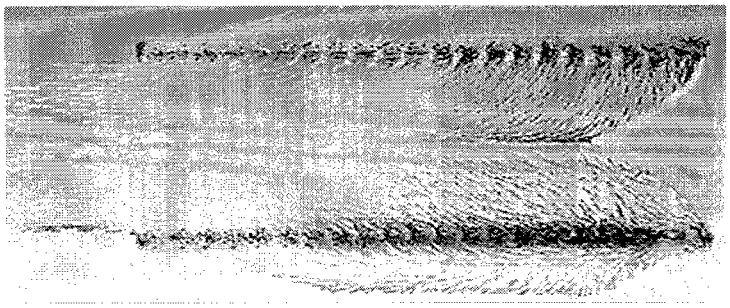
New Invention
Figure 9b

FLOW CONDITIONING FEATURE FOR SUCTION DIFFUSER

CROSS-REFERENCE TO RELATED APPLICATION

This application claims benefit to provisional patent application Ser. No. 61/722,411, filed 5 Nov. 2012, which is hereby incorporated by reference in its entirety.

BACKGROUND OF THE INVENTION

1. Field of the Invention

The present invention relates to a suction diffuser; and more particularly, the present invention relates to a suction diffuser for processing a fluid flowing in a process flow pipe.

2. Brief Description of Related Art

Known suction diffusers, including that shown in FIG. 1, are devices typically assembled to the inlet, or suction, side of a pump in a fluid handling system to minimize system footprint and optimize flow conditions into the pump, by straightening the flow, improving pump inlet performance parameters, making cross-sectional fluid velocity profile at the suction of the pump more uniform, and removing debris from the fluid flow. Optimized flow conditions improve the operating characteristics of the pump by requiring less power to perform its functions, and overall improving pump-diffuser system efficiency.

FIG. 1 includes one known suction diffuser generally indicated as 5 having a main suction diffuser body 5*a* with an inlet 5*a'*, an interior cavity 5*a*" and an outlet 5'", a baffle 5*b* arranged therein, and an outwardly contoured cover plate 5*c* coupled to one end of the main suction diffuser body 5*a*. In operation, incoming fluid $F_i$ passes though the inlet 5*a*' into the interior cavity 5*a*" and through the baffle 5*b*, and outgoing fluid $F_o$ is provided from the outlet 5'".

A problem with currently available suction diffusers is that, upon closer examination of the flow characteristics of the fluid passing through the diffuser and entering the pump, significant conditioning improvements could still be made. The flow paths of currently available suction diffusers contain numerous stagnation and recirculation zones which prevent the flow entering the pump from becoming uniform and creating high pressure head loss across the suction diffuser, which works detrimentally to the pump-suction diffuser system, consistent with that shown FIG. 9*a* herein.

SUMMARY OF THE INVENTION

According to some embodiments, the present invention may take the form of apparatus, such as a suction diffuser or arrangement having a main suction diffuser body and a flow conditioning arrangement.

The main suction diffuser body may be configured with an inlet to receive an incoming fluid, an interior cavity to receive the incoming fluid from the inlet, and an outlet to receive the incoming fluid from the interior cavity and provide an outgoing fluid.

The flow conditioning arrangement may be configured in relation to the inlet and may include a flow conditioning portion having at least one inwardly contoured surface, configured to extend into the interior cavity, diffuse the incoming fluid passing from the inlet into the interior cavity, and provide a flow conditioning that produces a uniform flow of the outgoing fluid by directing the incoming fluid towards the outlet, based at least partly on a contoured design corresponding to the at least one inwardly contoured surface.

In operation, the flow conditioning according to the present invention produces a more uniform flow of the outgoing fluid than the flow produced by the known prior art device, e.g., shown in FIG. 1. Compare FIGS. 9*a* and 9*b* below.

According to some embodiments, the present invention may include one or more of the following additional features:

The at least one inwardly contoured surface may be configured with a shape that is substantially conically contoured, including being quadric conically contoured, or convexly conically contoured. For example, the flow conditioning arrangement may include, or take the form of, a conically contoured cover plate configured with the flow conditioning portion, which may be used for the suction diffuser for improving its fluid flow conditions.

The flow conditioning portion may include a peripheral portion and a central or vertex portion configured to extent further or deeper into that interior cavity than the peripheral portion. At least one slot may be formed in, and extend between, the at least one inwardly contoured surface and the peripheral portion.

The flow conditioning arrangement may include a baffle configured in the interior cavity to restrain or regulate the flow of the fluid from the inlet to the outlet. The baffle may include an end portion configured with a shape that substantially corresponds to the shape of the at least one inwardly contoured surface so as to mate or fit together with the same, including when the flow conditioning arrangement is coupled to the main suction diffuser body.

The flow conditioning portion may be shaped as a pyramid with a square or other geometrically shaped base. By way of example, the at least one inwardly contoured wall may be configured with a shape that is substantially pyramidally contoured. The at least one inwardly contoured wall may include at least three triangular walls configured between an outer peripheral base portion and an inner central vertex portion. The at least three triangular walls may include four triangular flat walls between an outer square peripheral base portion and the inner central vertex portion. The at least three triangular walls may be configured with slots formed therein to receive one end of the baffle.

The flow conditioning portion may be configured with a shape that is substantially inwardly concavely contoured. For example, the at least one inwardly contoured surface may by configured as a concave wall having an outer peripheral base portion.

The flow conditioning portion may be configured or shaped as a helix for conditioning the flow with its vanes and angles in direct relationship to the overall curvature described or defined by the flow stream entering the suction diffuser on its required path. By way of example, the at least one inwardly contoured wall may be configured with a shape that is substantially helically contoured. The at least one inwardly contoured wall may be configured as a helically contoured wall extending from an outer peripheral base portion to a central vertex portion.

The flow conditioning portion may be configured or formed integrally to or with the main suction diffuser body.

The flow conditioning portion may be configured as, or form part of, an inwardly contoured plate or insert arranged between the inlet and an outer cover plate. For example, the flow conditioning portion may be configured as an insert in the suction diffuser, separate from the cover plate or other internal components. The design feature could also be incorporated into the main suction diffuser body or housing of the suction diffuser in lieu of a cover plate. The separate insert piece may be coupled to the main suction diffuser body by a separate cover plate.

The flow conditioning arrangement may be configured to substantially eliminate fluid recirculation and stagnation zones of the fluid flowing in the interior cavity to the outlet so as to provide a substantially uniform fluid flowing from the outlet.

In effect, the present invention provides a contoured design feature in a suction diffuser that will produce a more uniform flow of the fluid, e.g., entering the pump it is attached to. The contoured profile of the design feature conditions the fluid flow by directing the incoming fluid towards the outlet of the suction diffuser. This eliminates the fluid recirculation and stagnation zones that are prevalent in currently available suction diffusers. Lower pressure head loss of the pump-suction diffuser system makes its operation more efficient.

One advantage of the present invention is that it provides a suction diffuser having a new and unique ability to condition the fluid flowing in a process flow pipe.

BRIEF DESCRIPTION OF THE DRAWING

The drawing includes the following Figures, not drawn to scale:

FIG. 1 is a cross-sectional view of a suction diffuser assembly that is known in the art.

FIG. 2*a* is a cross-sectional view of apparatus in the form of a suction diffuser having a contoured cover plate, according to some embodiments of the present invention.

FIG. 2*b* is a perspective view of the contoured cover plate in FIG. 2*a*, according to some embodiments of the present invention.

FIG. 2*c* is an exploded assembly view of the contoured cover plate in FIG. 2*a*, according to some embodiments of the present invention.

FIG. 3*a* is a cross-sectional view of apparatus in the form of a suction diffuser having a contoured cover plate with a pyramidal or geometric contour, according to some embodiments of the present invention.

FIG. 3*b* is a perspective view of the contoured cover plate in FIG. 3*a*, according to some embodiments of the present invention.

FIG. 4 is a cross-sectional view of apparatus in the form of a suction diffuser having a contoured cover plate with a concave contour, according to some embodiments of the present invention.

FIG. 5 is a cross-sectional view of apparatus in the form of a suction diffuser having a contoured cover plate with a helical contour, according to some embodiments of the present invention.

FIG. 6 is a cross-sectional view of apparatus in the form of a suction diffuser having a contoured cover plate that is configured or formed integral to the main suction diffuser body, according to some embodiments of the present invention.

FIG. 7 is a cross-sectional view of apparatus in the form of a suction diffuser having a contoured plate that is inserted between a separate cover plate and a main suction diffuser body, according to some embodiments of the present invention.

FIG. 8 is a cross-sectional overlay view of the known suction diffuser shown in FIG. 1 and the suction diffuser having a flow conditioning portion, according to some embodiments of the present invention.

FIG. 9*a* is a diagram of fluid velocity vectors showing recirculation and stagnation zones that are the result of the old prior art design.

FIG. 9*b* is a diagram of fluid velocity vectors showing substantially no recirculation and stagnation zones that are the result of the new design, according to some embodiments of the present invention.

DETAILED DESCRIPTION OF THE INVENTION

FIGS. 2*a*-2*c*

Figure 2E:
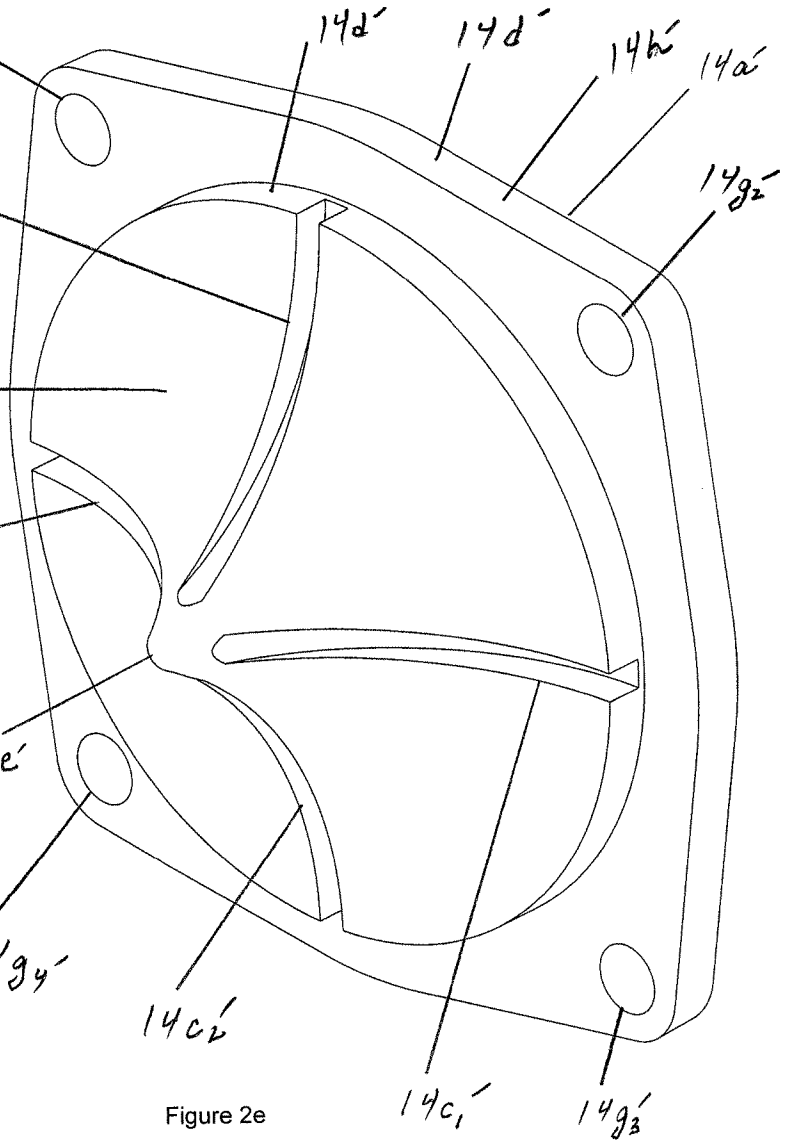
FIGS. 2*d* and 2*e* are perspective views of alternative embodiments of a contoured cover plate, according to some embodiments of the present invention.

According to some embodiments, and consistent with that shown in the Figures of the drawing, the present invention may take the form of apparatus, such as a suction diffuser or arrangement, e.g. generally indicated as 10 in FIGS. 2*a*-2*c*, featuring a main suction diffuser body or housing 12 and a flow conditioning arrangement generally indicated as 14.

The main suction diffuser body 12 may be configured with an inlet 12*a* to receive incoming fluid $F_i$, an interior cavity 12*b* to receive the incoming fluid $F_i$ from the inlet 12*a*, and an outlet 12*c* to receive the incoming fluid $F_i$ from the interior cavity and provide outgoing fluid $F_o$.

The flow conditioning arrangement 14 may be configured in relation to the inlet 12*a* and include a flow conditioning portion 14*a* having at least one inwardly contoured surface 14*b*, configured to extend into the interior cavity 12*b* (e.g., consistent with that shown in FIGS. 2*a* and 2*b*), diffuse the incoming fluid $F_i$ passing from the inlet 12*a* into the interior cavity 12*b*, and provide a flow conditioning that produces a uniform flow of the outgoing fluid $F_o$ by directing the incoming fluid $F_i$ towards the outlet 12*c*, based at least partly on a contoured design corresponding to the at least one inwardly contoured surface 14*b*.

The at least one inwardly contoured surface 14*b* may be configured as, or in the form of, a quadric conical surface, i.e., a conical surface having an inward curve, as shown in FIG. 2*b*. The scope of the invention is not intended to be limited to any particular curvature of the at least one inwardly contoured surface 14*b*, and embodiments are envisioned having no curve (i.e., being conical) or having more or less curvature than that shown in FIG. 2*b*. Moreover, embodiments are also envisioned in which the flow conditioning portion 14*a* has a contoured surface configured with an outward curve, e.g., including being an outward quadric curvature, or an outward spherical curvature, etc. Moreover still, embodiments are also envisioned in which the flow conditioning portion 14*a* has contoured surface configured with a conical surface, or is shaped as a cone, including being frusto-conical.

By way of example, the flow conditioning portion 14*a* may also be configured with at least one slot $\mathbf{14}c_1$, $\mathbf{14}c_2$, $\mathbf{14}c_3$, $\mathbf{14}c_4$, a peripheral portion 14*d* and a central or vertex portion 14*e*, where the at least one inwardly contoured surface 14*b* is configured there between. The peripheral portion 14*d* may be configured as a substantially cylindrical surface, consistent with that shown in FIG. 2*b*. The central or vertex portion 14*e* may be configured to extent further or deeper into that interior cavity 12*b* than the peripheral portion 14*d*, consistent with that shown in FIGS. 2*a* and 2*b*.

The flow conditioning portion 14*a* may be configured as, or take the form of, a contoured cover plate, as shown in FIGS. 2*a* to 2*c*, having a rim or flange 14*f* configured with openings 14$g_1$, 14$g_2$, 14$g_3$, 14$g_4$, as best shown in FIG. 2*b*. The openings 14$g_1$, 14$g_2$, 14$g_3$, 14$g_4$ may be configured to receive fasteners 14$h_1$, 14$h_2$, 14$h_3$, 14$h_4$ to couple the contoured cover plate 14*a* to the inlet 12*a*, consistent with that shown in FIG. 2*c*.

The flow conditioning arrangement 14 may also be configured with a baffle 16, one or more cylindrical screens, strainer or filters 18*a*, 18*b*, and one or more sealing rings 20, consistent with that shown in FIG. 2*c*.

The baffle 16 may be configured in the interior cavity 12*b* to restrain or regulate the flow of the fluid from the inlet 12*a* to the outlet 12*c*. The baffle 16 may be configured with end portions 16*a*, 16*b*. The end portion 16*a* may be configured with a shape that substantially corresponds to the shape of the at least one inwardly contoured surface 14*b* so as to mate or fit together with the same, e.g., when the flow conditioning arrangement 14 is coupled to the main suction diffuser body 12. The baffle 16 may also be configured with four deflectors plates 16$b_1$, 16$b_2$, 16$b_3$, 16$b_4$ configured in an X-shape with a central longitudinal axis and arranged about 90° equidistant in relation to one another. The central longitudinal axis of the baffle may be parallel to the longitudinal axis of the main suction diffuser body 12 when the baffle 16 is arranged in the interior cavity 12*b*. The baffle 16 may be configured in the cylindrical strainer 18*a*, 18*b* in order to strain, screen or filter the incoming fluid $F_i$. The scope of the invention is not intended to be limited to the number of deflectors plates, and embodiments are envisioned in which there are more than four deflector plates, and less than four deflector plates with the spirit of the present invention. The other end portion 16*b* is configured to rest on a ledge or rim 12*d* of the main suction diffuser body 12 when the baffle 16 is inserted into the interior cavity 14*b*.

The at least one inwardly contoured surface 14*b* may be configured with slots 14$c_1$, 14$c_2$, 14$c_3$, 14$c_4$, e.g., between the peripheral portion 14*d* and the central or vertex portion 14*e* to receive and engage edges of four deflectors plates 16$b_1$, 16$b_2$, 16$b_3$, 16$b_4$. The scope of the invention is not intended to be limited to the at least one inwardly contoured surface 14*b* being configured with slots like elements 14$c_1$, 14$c_2$, 14$c_3$, 14$c_4$. For example, embodiments are envisioned in which the at least one inwardly contoured surface 14*b* is configured with no slots to receive and engage edges of four deflectors plates 16$b_1$, 16$b_2$, 16$b_3$, 16$b_4$, is configured with indents formed to receive and engage edges of four deflectors plates 16$b_1$, 16$b_2$, 16$b_3$, 16$b_4$.

The flow conditioning portion 14*a* may also be configured with an outer edge 16*h* that is circular, as shown.

Figure 2D:
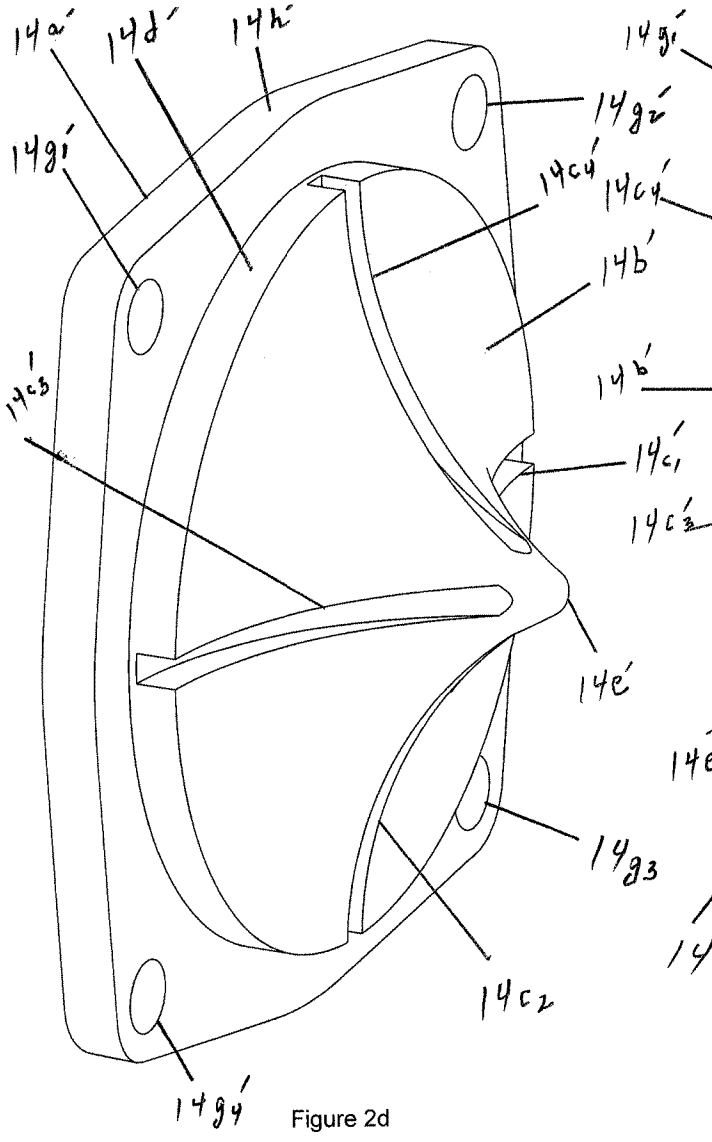

FIGS. 2*d* and 2*e* show alternative embodiments of the cover plate 14*a*', e.g., having an outer edge 14*h*' that is configured with a non-circular shape. The reference number shown in FIGS. 2*d* and 2*e* are consistent with the reference numbers shown in FIG. 2*b* with the addition of an apostrophe (i.e. "'"). The scope of the invention is not intended to be limited to the shape of the cover plate 14*a*, 14*a*'; and embodiments are envisioned, and intended to include, cover plates having outer edges that are circular as well as non-circular as well.

FIGS. 3*a*-3*b*

FIGS. 3*a*-3*b* show an embodiment, including a flow conditioning portion 140 that may be configured with a shape that is substantially pyramidally contoured and arranged in relation to the main suction diffuser body or housing 12. The main suction diffuser body 12 in FIG. 3*a* is the same as that shown in FIG. 2*a*.

By way of example, the flow conditioning portion 140 may be configured with four inwardly contoured surfaces in the form of four triangular walls 142*a* 142*b*, 142*c*, 142*d* formed between an outer square peripheral base portion 144 and an inner central vertex portion 146. The triangular walls 142*a* 142*b*, 142*c*, 142*d* may be configured with slots 148*a* 148*b*, 148*c*, 148*d* to receive and engage one end of a baffle 145. Each slot 148*a* 148*b*, 148*c*, 148*d* may be configured or formed to extend from the outer square peripheral base portion 144 and the inner central vertex portion 146, consistent with that shown in FIG. 3*b*.

The flow conditioning portion 140 may be configured with a rim or flange 150 configured with openings 152*a* 152*b*, 152*c*, 152*d* as shown in FIG. 3*b*. The openings 152*a* 152*b*, 152*c*, 152*d* may be configured to receive fasteners, like fasteners 14$h_1$, 14$h_2$, 14$h_3$, 14$h_4$ to couple the flow conditioning portion 140 to the inlet 12*a*, similar to, and consistent with, that shown in FIG. 2*c*. The four triangular walls 142*a* 142*b*, 142*c*, 142*d* may be configured to mate with a baffle indicated by reference label 145 (See also FIG. 2*c*)

The scope of the invention is not intended to be limited to any particular number of triangular walls or slots, and embodiments are envisioned having more than four triangular walls or slots, or less than four triangular walls or slots within the spirit of the present invention.

FIGS. 3*a*-3*b* show other elements that are labeled consistent with FIGS. 2*a*-2*c*.

FIG. 4

FIG. 4 show an embodiment having a flow conditioning portion 240 that may be configured with a shape that is substantially inwardly concavely contoured and arranged in relation to the main suction diffuser body or housing 12. The main suction diffuser body 12 in FIG. 4 is the same as that shown in FIGS. 2*a* and 3*a*. The flow conditioning portion 240 may include a concave wall 240*a* having an outer peripheral base portion 240*b*. The flow conditioning portion 240 may be coupled to the inlet 12*a* using fasteners, like fasteners 241$_a$, 241$_b$, similar to, and consistent with, that shown in FIGS. 2*c* and 3*a*. The concave wall 240*a* may be configured to mate with a baffle indicated by reference label 245 having a corresponding shape (See also FIG. 2*c*).

FIG. 4 shows other elements that are labeled consistent with FIGS. 2*a*-2*c*.

FIG. 5

FIG. 5 show an embodiment having a flow conditioning portion 340 that may be configured with a shape that is substantially helically contoured and arranged in relation to the main suction diffuser body or housing 12 (FIG. 2*a*). The main suction diffuser body 12 in FIG. 5 is the same as that shown in FIGS. 2*a*, 3*a* and 4. In effect, the flow conditioning feature may be shaped as a helix for conditioning the flow with its vanes and angles in direct relationship to the overall curvature described and defined by the flow stream entering the suction diffuser on its required path. The flow conditioning portion 340 may include a helically contoured wall 340*a* extending from an outer peripheral base portion 340*b* to a central vertex portion 340*c*. The helically contoured wall 340*a* may be configured with spirally angled vanes 340*d*. The flow conditioning portion 340 is coupled to the inlet 12*a* using fasteners, like fasteners 341$_a$, 341$_b$, similar to, and consistent with, that shown in FIGS. 2*c*, 3*a* and 4.

The helically contoured wall 340*a* may be configured and contoured to mate with a baffle indicated by reference label 345 having a corresponding shape (See also FIG. 2*c*).

FIG. 6 shows other elements that are labeled consistent with FIGS. 2*a*-2*c*, 3*a*, 4, and 5.

FIG. 6

FIG. 6 show an embodiment having a flow conditioning portion 440 that may be formed integrally to a main suction diffuser body 412. In effect, the flow conditioning portion 440 may be configured or formed integrally to the main suction diffuser body 412 as one piece. FIG. 6 shows the flow conditioning portion 440 formed integrally with the main suction diffuser body 412 in the form of an integral cover plate. Alternatively, the flow conditioning portion 440 may be formed integrally with the main suction diffuser body 412, and a separate cover plate attached thereto. The helically contoured wall 440*a* may be configured and contoured to mate with a baffle indicated by reference label 445 having a corresponding shape (See also FIG. 2*c*).

FIG. 6 shows other elements that are labeled consistent with FIGS. 2*a*-2*c*, 3*a*, 4, and 5.

FIG. 7

FIG. 7 show an embodiment having a flow conditioning portion 540 that may be formed as an insert portion 541 with a separate cover plate 542 for coupling the insert portion 540 to the main suction diffuser body 12. The flow conditioning portion 540 is configured with a substantially conically contoured, wall 540*a* (e.g., being quadric conically contoured (as shown), or convexly conically contoured) that may be configured and contoured to mate with a baffle indicated by reference label 545 having a corresponding shape (See also FIG. 2*c*).

FIG. 7 shows other elements that are labeled consistent with FIGS. 2*a*-2*c*, 3*a*, 4, and 5.

FIG. 8

FIG. 8 is a cross-sectional overlay view of the known suction diffuser shown in FIG. 1 and the suction diffuser having the flow conditioning portion, according to some embodiments of the present invention. The suction diffusers has slightly different configurations for the main suction diffuser body. In effect, the baseline model of the main suction diffuser body 5*a* in FIG. 1 is overlayed on top of a modified model of the main suction diffuser body 12*a*, consistent with that shown in FIGS. 2*a*, 3*a*, 4, 5 and 7. As shown, the modified model is configured to be about 10.375 inches in length, while the baseline model is configured to be about 10 inches in length, although the scope of the invention is not intended to be limited to any particular dimensions, including length. The scope of the invention is intended to include using the flow conditioning portion having at least one inwardly contoured surface disclosed in relation to FIGS. 2*a* through 7 according to the present invention, in conjunction with the main suction diffuser body 5*a* in FIG. 1 or the main suction diffuser body 12*a*, consistent with that set forth herein.

FIGS. 9*a*, 9*b*

FIG. 9*a* shows fluid velocity vectors having recirculation and stagnation zones that are the result of the prior art design, while FIG. 9*b* shows fluid velocity vectors having substantially no recirculation and stagnation zones that are the result of the design, according to some embodiments of the present invention. In effect, when the flow conditioning portion having the at least one inwardly contoured surface therein is configured to extend into the interior cavity, and diffuse the incoming fluid $F_i$ passing from the inlet into the interior cavity, the flow conditioning portion provides a flow conditioning that produces a substantially uniform flow of the outgoing fluid $F_o$ by directing the incoming fluid $F_i$ towards the outlet, based at least partly on a contoured design corresponding to the at least one inwardly contoured surface, consistent with that shown in FIG. 9*b*, and according to some embodiments of the present invention.

THE SCOPE OF THE INVENTION

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the present invention is described by way of example in relation to a centrifugal pump, the scope of the invention is intended to include using the same in relation to other types or kinds of pumps either now known or later developed in the future.

Although the invention has been described and illustrated with respect to exemplary embodiments thereof, the foregoing and various other additions and omissions may be made therein and thereto without departing from the spirit and scope of the present invention.

What we claim is:

1. A suction diffuser or arrangement comprising:

a main suction diffuser body configured with an inlet to receive an incoming fluid, an interior cavity to receive the incoming fluid from the inlet, and an outlet to receive the incoming fluid from the interior cavity and provide an outgoing fluid, the main suction diffuser body having a longitudinal axis; and a flow conditioning arrangement configured in relation to the inlet and comprising a contoured cover plate configured to couple to the main suction diffuser body and having at least one inwardly contoured surface, configured to extend into the interior cavity, diffuse the incoming fluid passing from the inlet into the interior cavity, and provide a flow conditioning that produces a uniform flow of the outgoing fluid by directing the incoming fluid towards the outlet, based at least partly on a contoured design corresponding to the at least one inwardly contoured surface, the contoured cover plate having a peripheral portion and a central or vertex portion, the at least one inwardly contoured surface having slots formed therein configured between the peripheral portion and the central or vertex portion, and a baffle configured in the interior cavity to restrain or regulate the flow of the fluid from the inlet to the outlet, the baffle having deflector plates with end portions, the deflector plates configured in a shape with a central longitudinal axis and arranged equidistant in relation to one another, the central longitudinal axis of the baffle being parallel to the longitudinal axis of the main suction diffuser body when the baffle is arranged in the interior cavity, the baffle having a center axial portion extending along the central longitudinal axis, the deflector plates extending radially from the center axial portion, each end portion configured with a corresponding shape that substantially corresponds to the slots of the at least one inwardly contoured surface so as to mate or fit together with the same.

2. A suction diffuser or arrangement according to claim 1, wherein the at least one inwardly contoured surface is configured with a shape that is substantially conically contoured, including being quadric conically contoured, or convexly conically contoured.

3. A suction diffuser or arrangement according to claim 1, wherein the contoured cover plate central or vertex portion is configured to extent further or deeper into that interior cavity than the peripheral portion.

4. A suction diffuser or arrangement according to claim 1, wherein the at least one inwardly contoured surface is configured with an associated shape that is substantially pyramidally contoured.

5. A suction diffuser or arrangement according to claim 4, wherein the at least one inwardly contoured surface comprises at least three triangular walls configured between an outer peripheral base portion and an inner central vertex portion.

6. A suction diffuser or arrangement according to claim 5, wherein the at least three triangular walls comprise four triangular flat walls between an outer square peripheral base portion and the inner central vertex portion.

7. A suction diffuser or arrangement according to claim 5, wherein the at least three triangular walls are configured with slots formed therein to receive the end portions of the deflection plate of the baffle.

8. A suction diffuser or arrangement according to claim 1, wherein the at least one inwardly contoured surface is configured or formed with an associated shape that is substantially inwardly concavely contoured.

9. A suction diffuser or arrangement according to claim 8, wherein the at least one inwardly contoured surface is configured as a concave wall having an outer peripheral base portion.

10. A suction diffuser or arrangement according to claim 1, wherein the at least one inwardly contoured surface is configured or formed with an associated shape that is substantially helically contoured.

11. A suction diffuser or arrangement according to claim 10, wherein the at least one inwardly contoured surface is configured as a helically contoured wall extending from an outer peripheral base portion to a central vertex portion.

12. A suction diffuser or arrangement according to claim 11, wherein the helically contoured wall is configured with vanes and angles for conditioning the flow in direct relationship to its curvature.

13. A suction diffuser or arrangement according to claim 1, wherein the contoured cover plate is configured or formed integrally to the main suction diffuser body.

14. A suction diffuser or arrangement according to claim 1, wherein the contoured cover plate is configured as, or takes the form of, an inwardly contoured plate or insert.

15. A suction diffuser or arrangement according to claim 1, wherein the flow conditioning arrangement is configured to substantially eliminate fluid recirculation and stagnation zones of the fluid flowing in the interior cavity to the outlet so as to provide a substantially uniform fluid flowing from the outlet.

16. A suction diffuser or arrangement according to claim 1, wherein the deflector plates comprise four deflector plates configured in an X-shape and arranged about the central longitudinal axis 90° equidistant from one another.

17. A suction diffuser or arrangement according to claim 1, wherein the baffle comprises a cylindrical strainer in order to strain, screen or filter the incoming fluid.

18. A suction diffuser or arrangement according to claim 1, wherein the baffle comprises at least three deflector plates that extend radially from the center axial portion.

* * * * *